US008366093B2

(12) United States Patent
Keil et al.

(10) Patent No.: US 8,366,093 B2
(45) Date of Patent: Feb. 5, 2013

(54) METHOD AND APPARATUS FOR DETERMINING A SUB-GROUP OF A GROUP OF SHEETS IN A STREAM OF SHEETS

(75) Inventors: Christian Keil, Oberottmarshausen (DE); Clemens Hauser, Kutzenhausen (DE); Volker Wagenknecht, Harburg (DE); Bernd Hoepner, Augsburg (DE)

(73) Assignee: Boewe Systec GmbH, Augsburg (DE)

( * ) Notice: Subject to any disclaimer, the term of this patent is extended or adjusted under 35 U.S.C. 154(b) by 0 days.

(21) Appl. No.: 13/339,772

(22) Filed: Dec. 29, 2011

(65) Prior Publication Data

US 2012/0169004 A1 Jul. 5, 2012

Related U.S. Application Data

(63) Continuation of application No. PCT/EP2010/061318, filed on Aug. 3, 2010.

(30) Foreign Application Priority Data

Aug. 3, 2009 (DE) ..... 10 2009 035 956

(51) Int. Cl.
*B65H 5/24* (2006.01)

(52) U.S. Cl. ..... 270/58.01; 270/52.03; 270/58.3

(58) Field of Classification Search ..... 270/58.01, 270/52.01, 52.03, 58.3; 198/418.7, 444, 198/426, 431, 571
See application file for complete search history.

(56) References Cited

U.S. PATENT DOCUMENTS

| | | | | |
|---|---|---|---|---|
| 7,197,375 | B2 * | 3/2007 | Flores et al. | 700/224 |
| 7,198,260 | B2 | 4/2007 | Huber et al. | |
| 7,870,945 | B2 * | 1/2011 | Mileaf | 198/617 |
| 7,913,990 | B2 * | 3/2011 | Nakamura et al. | 270/58.11 |
| 2002/0078012 | A1 | 6/2002 | Ryan et al. | |
| 2003/0112479 | A1 | 6/2003 | Huber et al. | |
| 2003/0197321 | A1 | 10/2003 | Schwab | |
| 2005/0056989 | A1 | 3/2005 | Schwab | |
| 2007/0053001 | A1 | 3/2007 | Huntley et al. | |
| 2010/0090387 | A1 * | 4/2010 | Takenouchi et al. | 270/58.01 |

FOREIGN PATENT DOCUMENTS

| | | | |
|---|---|---|---|
| DE | 199 50 354 | C1 | 6/2001 |
| DE | 100 50 438 | C1 | 1/2002 |
| EP | 0 729 078 | A2 | 8/1996 |
| EP | 1 768 016 | A2 | 3/2007 |
| EP | 1 770 503 | A2 | 4/2007 |
| WO | 01/28903 | A1 | 4/2001 |
| WO | 2006/035496 | A1 | 4/2006 |

OTHER PUBLICATIONS

Official Communication issued in International Patent Application No. PCT/EP2010/061318, mailed on Nov. 16, 2010.

* cited by examiner

*Primary Examiner* — Leslie A Nicholson, III
(74) *Attorney, Agent, or Firm* — Keating & Bennett, LLP

(57) ABSTRACT

A method for determining a subgroup of a group of sheets in a sheet stream starting from a group start of the group comprises determining the subgroup end of the subgroup based on a sheet state parameter. The subgroup is determined by the group start and the subgroup end and comprises a variable number of sheets. The sheet state parameter determines which sheet in the sheet stream is a group end of the group of sheets.

17 Claims, 16 Drawing Sheets

METHOD AND APPARATUS FOR DETERMINING A SUB-GROUP OF A GROUP OF SHEETS IN A STREAM OF SHEETS

CROSS-REFERENCE TO RELATED APPLICATIONS

This application is a continuation of copending International Application No. PCT/EP2010/061318, filed Aug. 3, 2010, which is incorporated herein by reference in its entirety, and additionally claims priority from German Application No. 102009035956.7, filed Aug. 3, 2009, which is also incorporated herein by reference in its entirety.

BACKGROUND OF THE INVENTION

Embodiments according to the invention relate to sheet handling plants and in particular to a method and an apparatus for determining a subgroup of a group of sheets in sheet stream.

Sheet handling plants process, for example, paper rolls having documents printed thereon. Such printed paper rolls will in the following also be referred to as sheet stream. A sheet stream includes groups of associated sheets, which are associated, for example, as regards to content. During processing the sheet stream in the sheet handling plant, the sheets are singularized and the sheets are collected in a group.

Paper handling systems are mainly applied by large companies, banks, insurance companies, service companies, etc. In these companies, the paper handling systems serve to process large amounts of paper, such as invoices, reminders, accounts, insurance policies or checks. In many cases, individual papers to be handled by such paper handling systems are generated by high-speed printers printing letters, forms, etc. on a web. This web is typically provided from a large supply roll to the printer and supplied to the paper handling system after printing.

FIGS. 14 and 15 show a schematic representation of a sheet handling plant 1500. The sheet handling plant 1500 in FIG. 14 comprises a separating device 1510, a merger 1520, a stop location 1530, a first collecting station 1540 and a second collecting station 1550. The sheets of the sheet stream 1502 are singularized by the separating device 1510, also called cutting device or cutting machine. Then, the sheets are placed on top of each other or superimposed by the merger 1520 and transferred to the stop location 1530. From there, the sheets reach the first collecting station 1540, where all sheets of a subgroup are collected and output to the second collecting station 1540. In the second collecting station 1550, for example, all subgroups of a group are collected and the whole group is output.

A group of sheets can, for example, be invoices, reminders, accounts, insurance policies or checks belonging to the same person. Then, a subgroup of sheets comprises a portion of the sheets of the group.

The merger 1520 or the stop location 1530 can be implemented to retain one or several sheets of a row that do not belong to the same subgroup as the first sheet of the row.

The sheet handling plant shown in FIG. 15 essentially corresponds to the sheet handling station shown in FIG. 14, however, instead of the second collecting station, it comprises a folding unit 1560 followed by two transport modules 1570, 1580. The folding unit 1560 can fold the sheets of a group or subgroup and provide them to an inserter for inserting into an envelope. The completely filled envelopes can then be collected at the depositing location.

FIG. 16 shows a schematic illustration of part of a sheet handling plant 1600. In addition to a separating device 1510, a merger 1520 and a stop location 1530, a supply device 1610 is shown. The supply device 1610 can, for example, provide the sheet stream 1502 in the form of an endless web from a roll 1612 to the separating device.

FIG. 17 shows a further schematic illustration of a sheet handling plant 1700. The structure of the sheet handling plant 1700 essentially corresponds to the plant of FIG. 14. However, the merger 1520 is based on a different design principle (superimposing or diverting the sheets) and a transport module 1710 exists between the merger 1520 and the separating device 1510.

Further separating devices are described, for example in EP 1741653 A1 and WO 2006/034596 A1. EP 1741653 A1 shows, for example, a cutting plant for singularizing sheets of a sheet stream. Here, the sheet stream is first separated longitudinal to the main processing direction and the resulting webs are superimposed such that the sheets that have been adjacent to each other before separation will be on top of each other. Then, a separation perpendicular to the main processing direction follows.

WO 2006/034596 shows a similar paper separation means, wherein the web with the printed sheet stream is again first cut longitudinal to the main processing direction and then, after placing the sheets previously adjacent to each other on top of each other singularized perpendicular to the main processing direction.

A problem with such paper or sheet handling plants is that specific parts of such paper processing plants cannot process any number of sheets simultaneously. For example, a folding unit can only process a specific number of sheets simultaneously. Since a group in the sheet stream, however, can be of any size, the same frequently includes more sheets than the maximum number of simultaneously processable sheets. Therefore, such groups have to be divided into subgroups. In known systems, for example, subgroups are formed with the same number of sheets. Thereby, it frequently happens that after singularizing, individual sheets will be processed in the following operating steps. When the groups in the sheet stream have a disadvantageous position and length, this can result in a significantly worse throughput of the paper handling plant than theoretically possible. A subgroup is therefore formed, for example, after four sheets, independent of the group end and of paired or unpaired sheet sequences. This results, for example, in many single sheet entries into the collecting station.

In a specific example, for dividing large groups of sheets, normally, the subgroups are already formed in the merger, which are collected in the first of two collecting stations and subsequently collected in the second collecting station to form the complete group. For this, a fixed number of sheets per intermediate output are predetermined in the merger. One bit is defined, which is set by the merger at the subgroup end, such that the collecting station, when this bit arrives, also detects the subgroup end and hence starts an intermediate output. Also, by reading after a predetermined adjustable number of sheets, a subgroup end bit can be generated. A disadvantage of this method is that the subgroup formation, depending on the group distribution on the incoming paper stream or sheet stream can result, for example, in two unpaired outputs, although the two outputs belong to the same group, but to different subgroups. Additionally, a subgroup consisting of only one input into the collecting station is also disadvantageous for the cycle performance or throughput, since this input immediately causes an output of the collecting station. However, this is only possible in the collecting station when the output drive is again ready for output from the previous cycle.

In this regard, FIG. 2 shows a schematic illustration of a sheet stream 200 with a constant number of sheets 210 in a subgroup. The sheet stream is shown once prior to singularizing and once after singularizing and superimposing the sheets of a row. A subgroup comprises, for example, exactly four sheets. In this example, the sheet stream 200 has two adjacent sheets 210 each in one row and a main processing direction 230 marked by the arrow. The figure shows a paired start of the subgroup on sheet 1 and a subgroup end 220 on sheet 4. FIG. 2 can, for example, represent the paper stream in the cutting machine.

A group of five sheets having an unpaired start is significantly worse as regard to cycle performance or throughput. In this regard, FIG. 3 shows a schematic illustration of a sheet stream 300 having a constant number of sheets 210 in a subgroup. In this example, first, an entry of a single sheet in a first operating cycle, followed by two sheets in a second operating cycle and again a single sheet in a third operating cycle into the collecting station of a sheet handling plant would result. Then, the subgroup end 220 would be reached and the subgroup would be output by the collecting station. Then, in a further operating cycle, an entry of a further single sheet into the collecting station would take place and the same would be output individually again by the collecting station, since the group end 310 is reached. Thus, four operating cycles would be necessitated for processing five sheets.

FIG. 4 shows a schematic illustration of further examples 400 of a sheet stream having a constant number of sheets in a subgroup. Here, it can be seen that depending on the number of sheets in a group and a paired or unpaired start, the cycle performance rises or falls.

A known approach for improving cycle performance or throughput is optimizing the print stream. This means the order in which the groups of sheets are printed on the web is changed. For example, the sheet groups are sorted according to group size.

EP 1770503 A2 and US 2007/0053001 A1 show options for optimizing the print stream prior to printing. This variation has two significant disadvantages. On the one hand, the cycle performance can only be increased when optimization already takes place prior to printing. For webs that are already printed, these methods cannot be applied. On the other hand, optimizing the print stream necessitates high computing power, in particular when the number of groups becomes large.

SUMMARY

According to an embodiment, a method for determining a subgroup of a group of sheets in a sheet stream starting from a group start of the group, wherein the subgroup is determined by the group start and a subgroup end, and wherein the subgroup includes a variable number of sheets, wherein the sheet stream includes a plurality of successive rows of sheets, wherein one row is arranged perpendicular to a main processing direction of the sheet stream, and wherein each row includes at least two adjacent or superimposed sheets, may have the step of: determining the subgroup end of the subgroup based on a sheet state parameter, wherein the sheet state parameter determines which sheet in the sheet stream is a group end of the group of sheets.

According to another embodiment, an apparatus for determining a subgroup of a group of sheets in a sheet stream starting from a group start of the group, wherein the subgroup is determined by the group start and a subgroup end, and wherein the subgroup includes a variable number of sheets, wherein the sheet stream includes a plurality of successive rows of sheets, wherein one row is arranged perpendicular to a main processing direction of the sheet stream, and wherein each row includes at least two adjacent or superimposed sheets, may have: a subgroup determiner, which is implemented to determine a subgroup end of the subgroup based on a sheet state parameter, wherein the sheet state parameter determines which sheet in the sheet stream is a group end of the group of sheets.

According to another embodiment, a sheet handling plant for processing a sheet stream, wherein the sheet stream includes a plurality of successive rows of sheets, wherein each row includes at least two adjacent or superimposed sheets, may have: an apparatus for determining a subgroup of a group of sheets in a sheet stream starting from a group start of the group, wherein the subgroup is determined by the group start and a subgroup end, and wherein the subgroup includes a variable number of sheets, wherein the sheet stream includes a plurality of successive rows of sheets, wherein a row is arranged perpendicular to a main processing direction of the sheet stream, and wherein each row includes s at least two adjacent or superimposed sheets, with a subgroup determiner, which is implemented to determine a subgroup end of the subgroup based on a sheet state parameter, wherein the sheet state parameter determines which sheet in the sheet stream is a group end of the group of sheets; and a collecting location which is implemented to collect sheets of a subgroup and to output the subgroup after collecting all sheets of the subgroup, wherein the subgroup is determined by the apparatus for determining a subgroup.

Another embodiment may have a computer program having a program code for performing, when the computer program runs on a computer or microcontroller, a method for determining a subgroup of a group of sheets in a sheet stream starting from a group start of the group, wherein the subgroup is determined by the group start and a subgroup end, and wherein the subgroup includes a variable number of sheets, wherein the sheet stream includes a plurality of successive rows of sheets, wherein a row is arranged perpendicular to a main processing direction of a sheet stream, and wherein every row includes at least two adjacent or superimposed sheets, including: determining the subgroup end of the subgroup based on a sheet state parameter, wherein the sheet state parameter determines which sheet in the sheet stream is a group end of the group of sheets.

Embodiments according to the invention are based on the central idea that groups of sheets in a sheet stream are divided into subgroups having a variable number of sheets, and not, as before, for example a constant number of sheets. An intelligent determination of subgroups can be made when, based on a sheet state parameter, information exists which sheet in the sheet stream is the group end of the group of sheets. Thereby, it can, for example, already be sufficient to know that none of the next x sheets (x can be 1 to any number of sheets) is the group end of the group.

Thereby, for example, sheets that are adjacent to another or are superimposed in a row can be incorporated in the same subgroup, or the subgroup end can be placed such that a subgroup extends across two operating cycles, whereby the cycle performance and/or throughput of a sheet handling plant or a sheet processing plant can be significantly increased or processing the sheet stream can be simplified or optimized. Incorporating all sheets of a row into a subgroup can increase the cycle performance, since then all sheets of a row can be processed in one operating cycle. Extending a subgroup across at least two operating cycles can again improve the cycle performance, since several inputs or entries into a collecting station are possible while the output operation of the collecting station (for outputting the previous subgroup) is still running. In this way, the time until the collecting station is again ready for output can be used.

In contrary to methods optimizing the print stream prior to printing, the described concept can also be used when the sheet stream exists already in printed form. Even when sheets have not yet been printed, the method is advantageous, since only little computing effort is necessitated for determining the subgroups and not the whole print stream has to be changed.

BRIEF DESCRIPTION OF THE DRAWINGS

Embodiments of the present invention will be detailed subsequently referring to the appended drawings, in which.

DETAILED DESCRIPTION OF THE INVENTION

In the following application, the same reference numbers are used for objects and functional units having the same or similar functional characteristics.

Several of the following embodiments and figures show a sheet stream having two adjacent sheets per row. However, the inventive concept can also be applied to a sheet stream having 3, 4 or more sheets in one row. In the same way, the sheets of a row can, for example, be adjacent, on top of one another or also laterally offset to one another. Further, the sheets of the sheet stream, as shown in some embodiments and figures, can still be connected to one another or already be singularized. The sheets of the sheet stream can, for example, be printed on an endless paper, a foil or another carrier material, or can be provided as individual sheets for taking off from one or several stacks. For example, the sheets can be printed on an endless web, which are then separated longitudinal to the main processing direction and the resulting two or several webs are superimposed for further processing.

Figure 1:
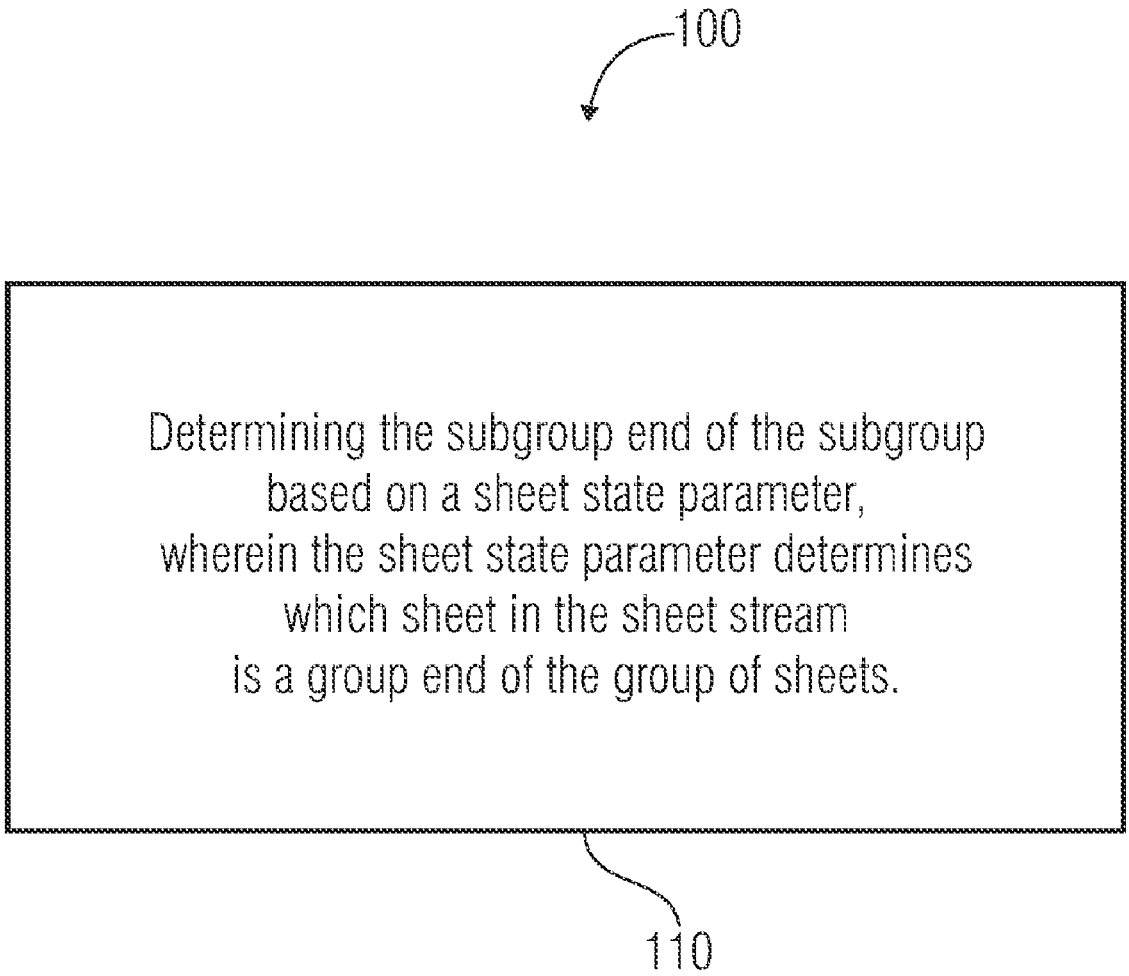
FIG. 1 is a flow diagram of a method for determining a subgroup of a group of sheets.
Figure 2:
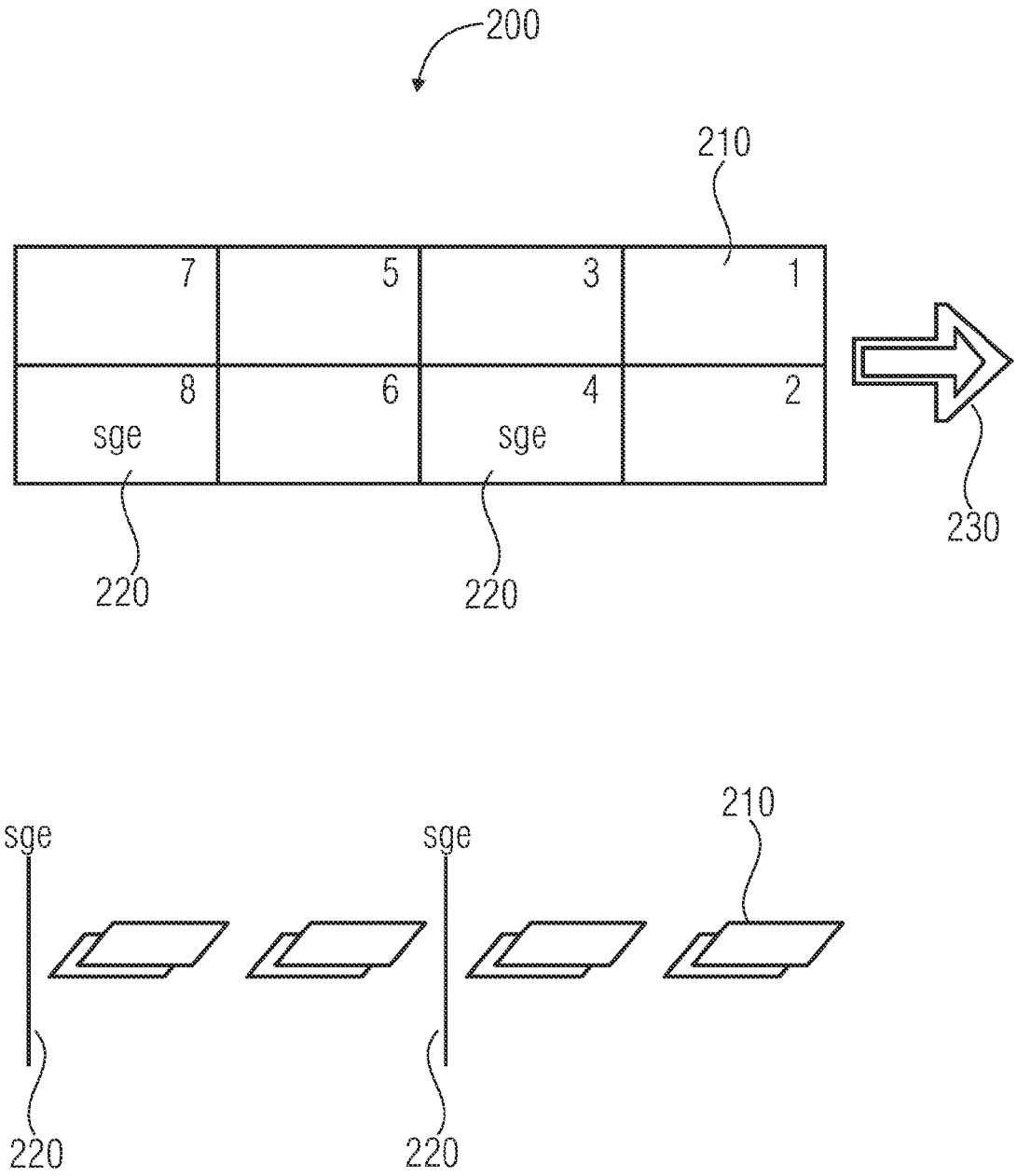
FIG. 2 is a schematic illustration of a sheet stream having a constant number of sheets in a subgroup.
Figure 3:
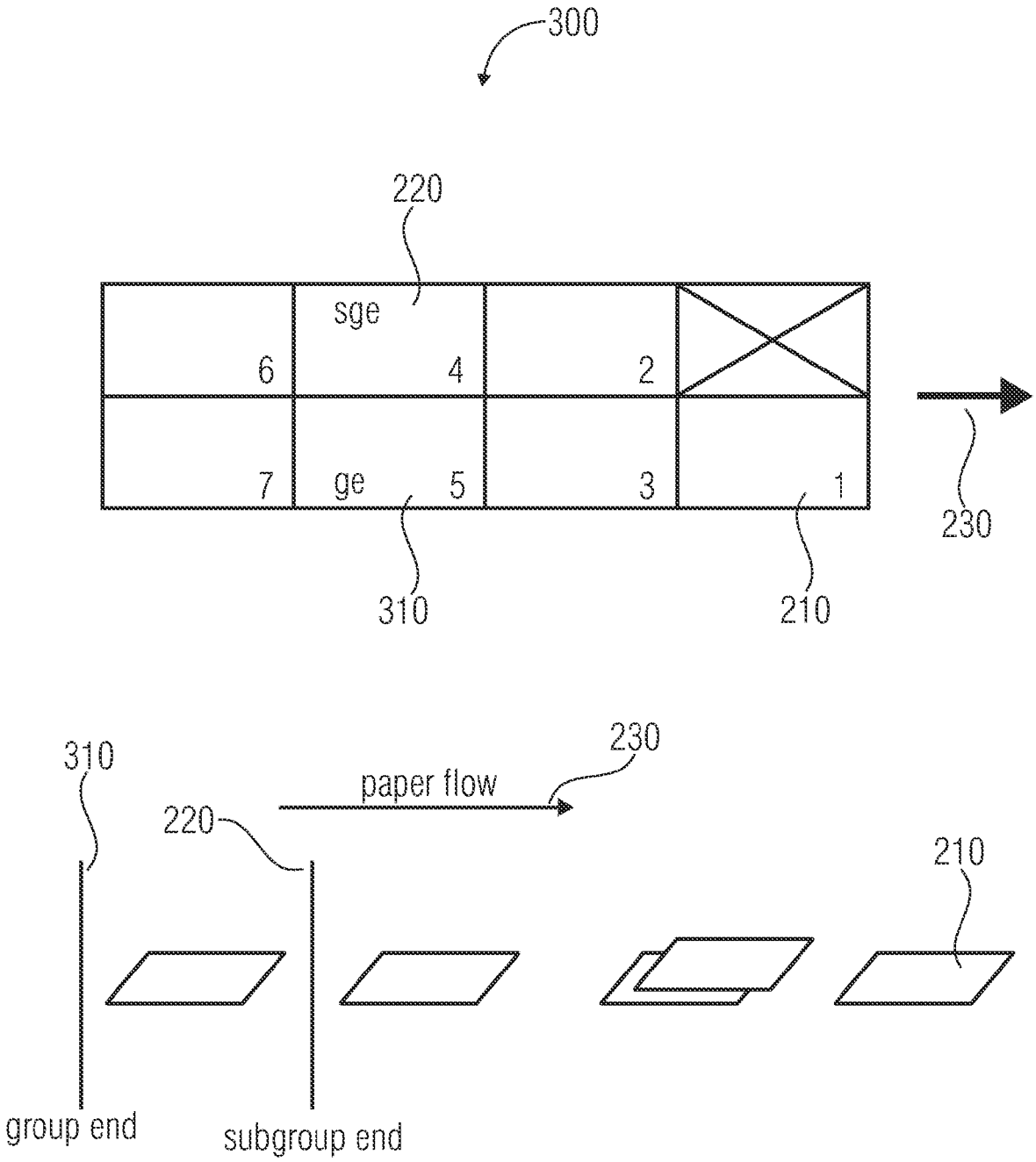
FIG. 3 is a schematic illustration of a sheet stream having a constant number of sheets in a subgroup.
Figure 4:
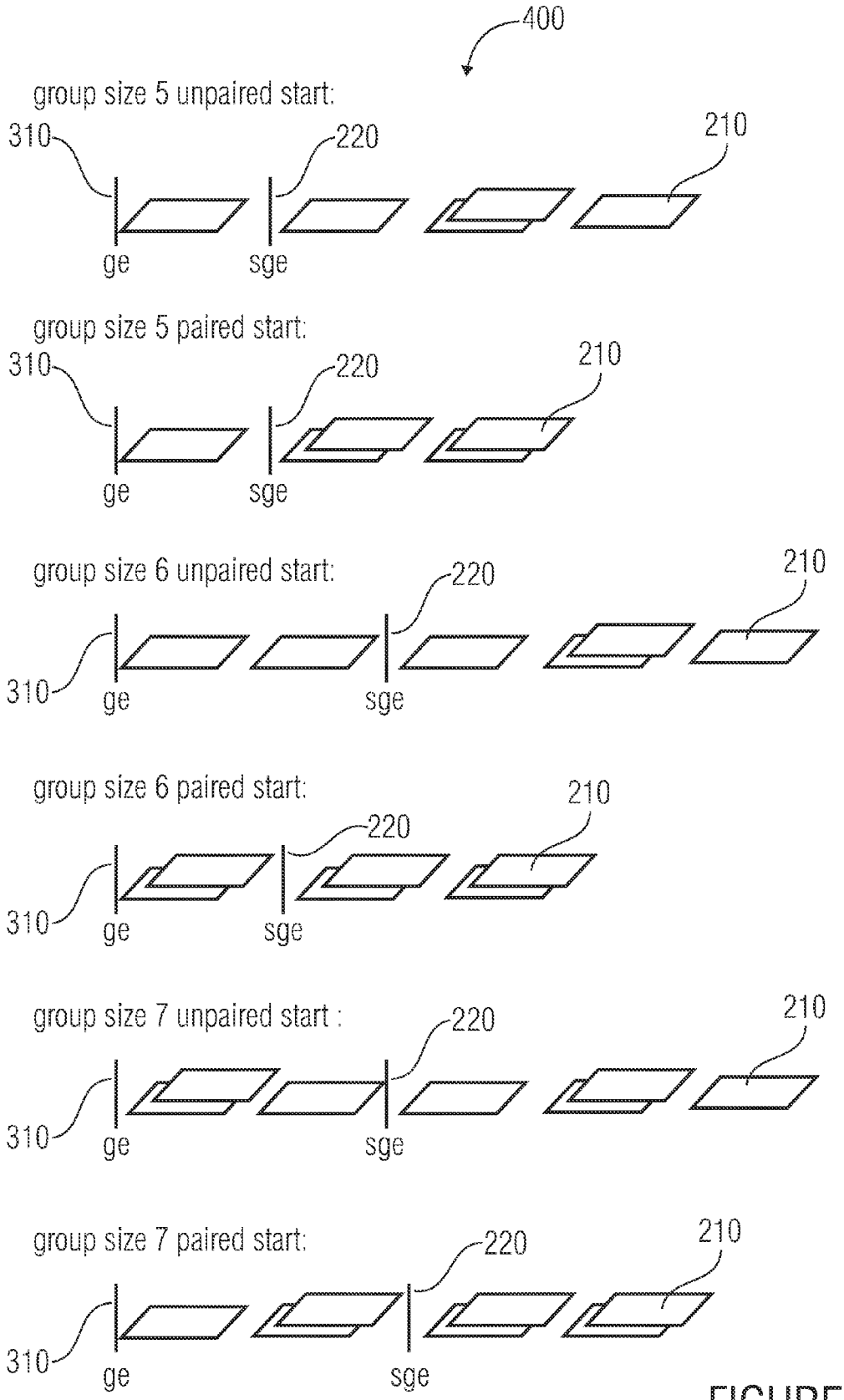
FIG. 4 is a schematic illustration of several examples of a sheet stream having a constant number of sheets in a subgroup.

FIG. 1 shows a flow diagram of a method 100 for determining a subgroup of a group of sheets in a sheet stream starting from a group start corresponding to an embodiment of the invention. The subgroup is determined by a group start and a subgroup end and comprises a variable number of sheets. The method comprises determining 110 the subgroup end of the subgroup based on a sheet state parameter. The sheet state parameter determines which sheet in a sheet stream is a group end of the group of sheets.

By determining the subgroup with a variable number of sheets, optimizing the cycle performance and/or the throughput of a sheet handling plant or sheet processing plant can be enabled. The cycle performance or throughput relates, for example, to a number of processable sheets per time unit (for example, sheets per minute). Thus, the number of sheets of the determined subgroup can differ, for example, from the number of sheets of a previously determined subgroup. Thus, the subgroup size can be determined such that the throughput of sheets per time unit of the sheet handling plant can be increased.

The sheet forming the group start can, for example, be determined by the group end of the directly previous group. Alternatively, the group start can also be determined by the sheet state parameter. For this, for example, state information can be printed on the sheet which forms the group start.

The sheet state parameter can be determined, for example, based on state information on at least one of the sheets or from a database. The database includes, for example, information on the whole sheet stream or the print stream of the sheet stream. Thereby, the group start and the group end of every group can be known.

The state information can be, for example, an identification of the first sheet of a group and hence the group start or an identification of the last sheet of a group and hence the group end. For example, both group start and group end can be marked. Alternatively, for example, the sheets of a group can be numbered and thereby a group start can be detected, for example, by page no. 1. Alternatively, for example, every second, third or x-th sheet of a group could be marked and from this, the group start or the group end could be inferred.

Figure 5:
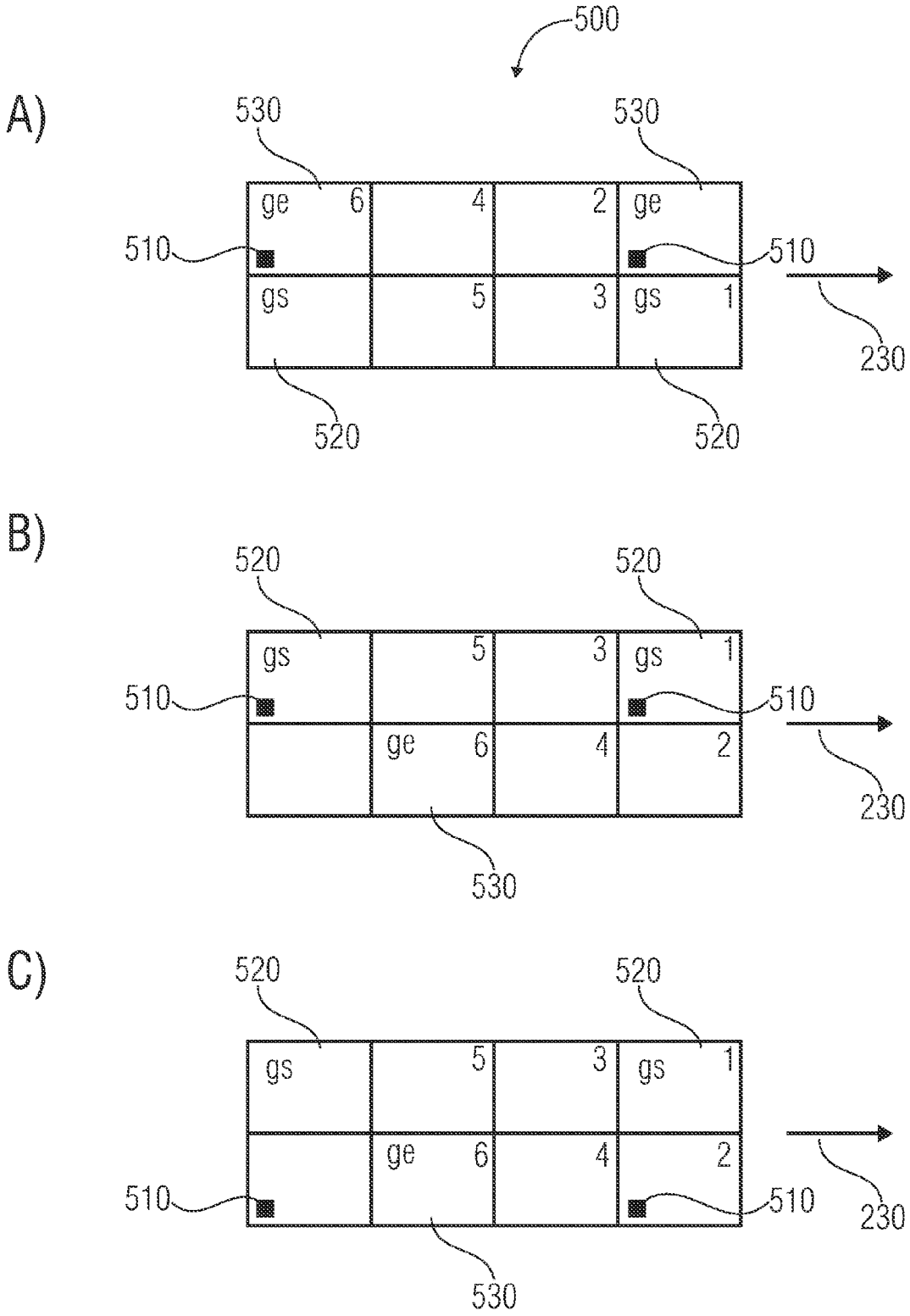
FIG. 5*a*, 5*b*, 5*c* is a schematic illustration of possible state information for determining the sheet state parameter.

FIGS. 5*a*, 5*b* and 5*c* show a schematic illustration 500 of possible state information 510 for determining the sheet state parameter corresponding to an embodiment of the invention. FIG. 5*a* shows a section of a sheet stream with eight sheets, six sheets of which belong to a group. In this example, the sheets representing a group end 530 are marked with state information 510. Alternatively, FIG. 5*b* shows an example where the group start 520 is respectively marked with state information 510 and FIG. 5*c* an example where every second sheet of a group is marked with state information 510.

State information can, for example, be detected by a detector or sensor, and the sheet state parameter can be determined based on the state information. The detector can be, for example, an optic or magnetic sensor (e.g. OCR reading, optical character recognition), a mechanical sensor detecting an imprint or a contactless RFID sensor (radio frequency identification). Accordingly, the state parameter can be realized, for example, as optically recognizable print, magnetic marking, imprint or RFID chip.

The sheet state parameter of a sheet can indicate, for example, whether the sheet is a group start or no group start or whether the sheet is a group end or no group end. It is, for example, sufficient to know whether a sheet is a group end or no group end. Thereby, the sheet state parameter can be illustrated, for example, by a bit set for a sheet or not, depending on whether the sheet is a group end or not. For example, the state information can each mark the group start of a group, wherein, however, also the group end of the previous group is determined. Thereby, the sheet state parameter can again be determined such that the group end of a group is respectively determined by the sheet state parameter. Alternatively, the sheet state parameter can also, for example, indicate the group start of every group and hence indirectly refer to the group end of the previous group.

If the group of sheets is smaller than a maximum subgroup sheet number, dividing into subgroups is not necessitated. The whole group can be processed as one. The maximum number of sheets in a subgroup (maximum subgroup sheet number) can be determined, for example, by the fact that not more than a specific number of sheets can be processed together in a processing step within a sheet handling plant.

In some embodiments according to the invention, determining the subgroup end is based on a sheet state parameter determination depth of the sheet state parameter. The sheet state parameter determination depth indicates a number of successive sheets in a sheet stream, wherein for the number of successive sheets the associated sheet state parameters are known at a time of determining the subgroup end. Determining the subgroup end is at least based on one of the associated sheet state parameters.

The sheet state parameter determination depth corresponds, for example, to a reading depth with respect to a detector or sensor detecting the state information of the sheet. The sheet state parameter determination depth can be, for example, four, six, eight or any other specific number of sheets. If, for example, only the sheets representing a group end of a group are marked with state information, it can at least be determined whether the group end is within the state parameter determination depth. If in this example, no state information is detected on any of the sheets within the sheet state parameter determination depth, the sheet state parameter is, for example, the same for each of these sheets and indicates that none of these sheets is a group end. Thus, the group end is outside the state parameter determination depth.

If, for example, a detector is used for detecting state information on the sheets of the sheet stream, the same also has a fixed distance to that point in the sheet handling plant where the subgroup end of the subgroup has to be determined. The number of sheets lying between these two points during processing the sheet stream can be referred to as sheet state parameter determination depth or reading depth.

In some embodiments according to the invention, the sheet stream comprises a plurality of successive rows of sheets. A row is arranged perpendicularly to a main processing direction of the sheet stream and comprises at least two adjacent or superimposed sheets.

Depending on the design of the sheet processing plant, at the time of determining the subgroup end, the sheets of the sheet stream are connected to each other, singularized or only separated from each other longitudinal to the main processing direction and can be arranged, for further processing, adjacent, superimposed or laterally offset to each other.

Within the sheet stream, the sheet state parameter determination depth can then, for example, range from a start sheet of a determination depth start row to an end sheet of a subsequent determination depth end row, and can thus state a number of successive sheets corresponding to one or a plurality of a number of sheets within a row. The group end is within the sheet state parameter determination depth, when the sheet state parameters of the sheets of the sheet stream are stored in a database. This is, for example, the case when the print stream is known.

In some embodiments according to the invention, the subgroup end is determined during an operating cycle and is determined again in a subsequent operating cycle. Here, the newly determined subgroup end can correspond to the previously determined subgroup end or can be further downstream in the sheet stream in a main processing direction than the previously determined subgroup end. Thus, the subgroup end can be determined again within every operating cycle and thereby, the cycle performance can be optimized further. This is, for example, of interest when the group end is outside the sheet state parameter determination depth, since the sheet state parameters of further sheets are known in the next operating cycle and, for example, the subgroup can be increased when the group end is still not within the sheet state parameter determination depth.

In some embodiments according to the invention, the subgroup end is determined, such that all adjacent or superimposed sheets of a row belong to the subgroup, when the group end is not within a maximum subgroup sheet number in the sheet stream. Thereby, when determining the subgroup, it is determined whether the group end is within the maximum subgroup sheet number.

Since the sheets of one row can be processed together within one operating cycle, it is advantageous to allocate the same to the same subgroup. If a subgroup end were not at the end but within a row, the sheets of the row would be separated at this location and processed in two successive operating cycles instead of in one operating cycle. Thus, by determining the subgroup end at the end of a row, the cycle performance of a sheet handling plant can be increased.

In a sheet stream having two adjacent or superimposed sheets, a termination of a subgroup can also be called "paired termination", when the subgroup end is on a last sheet of a row and hence the whole row belongs to the subgroup. Correspondingly, the termination of a subgroup can also be called "unpaired termination" when the subgroup end is not on a last sheet of a row. Thus, as described above, a paired termination can be advantageous.

Figure 6:
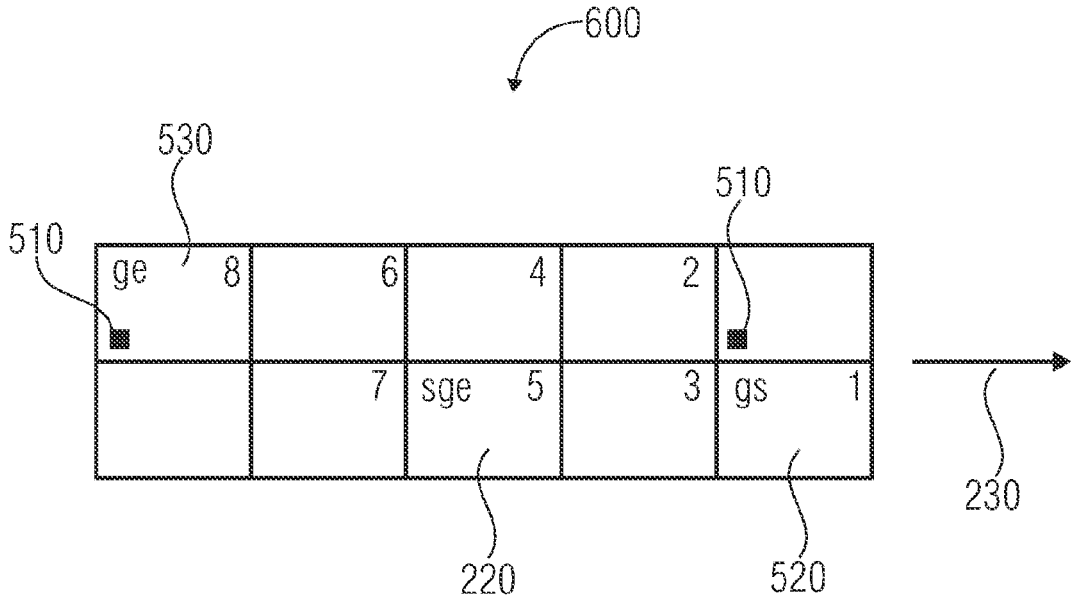
FIG. 6 is a schematic illustration of a sheet stream having a specific subgroup.

Correspondingly, FIG. 6 shows a schematic illustration of a sheet stream 600 having a specific subgroup according to an embodiment of the invention. Here, the sheet stream 600 shows a group having 8 sheets, wherein the group end 530 is marked with state information 510. The maximum subgroup sheet number is, for example, 6 sheets. The subgroup end 220 can then be set at the end of a row, for example, on sheet 5. The determined subgroup could then be processed in three operating cycles. Then, the next subgroup comprises three sheets and can be processed in two operating cycles. If the first group ended, for example, at sheet 4, the second subgroup would necessitate an additional operating cycle for processing sheet 5. Alternatively, the subgroup end 220 could also be set on the third sheet.

In some embodiments according to the invention, a last sheet of a row is determined as subgroup end, when the group end is not within the sheet state parameter determination depth. The row comprising the subgroup end is directly before the determination depth end row in the main processing direction. Thus, when determining the subgroup, it is determined whether the group end is within the sheet state parameter determination depth.

Thus, it can be useful to place the subgroup end not on the last sheet within the sheet state parameter determination depth, since then entry into a subsequent collecting station would only take place when the group end is directly in the next row. Since collecting stations might need more time for outputting collected sheets than for the entry, the cycle performance of the sheet handling plant can be improved further when, possibly, at least two entries into the collecting station take place during which output can then take place.

Figure 7:
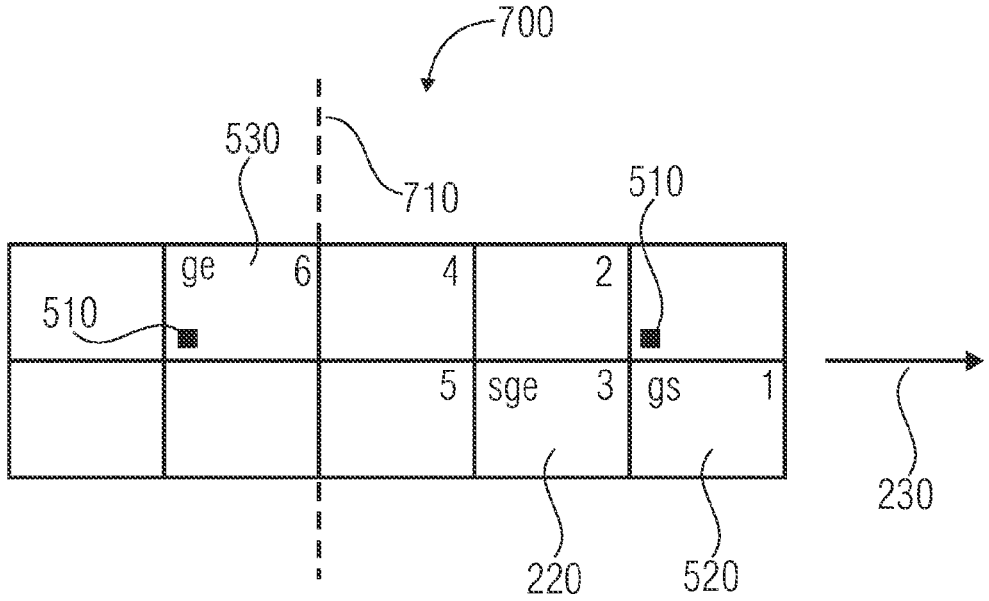
FIG. 7 is a schematic illustration of a sheet stream having a specific subgroup.

Correspondingly, FIG. 7 shows a schematic illustration of a sheet stream 700 having a specific subgroup corresponding to an embodiment of the invention.

Here, the sheet stream 700 shows a group having six sheets, wherein the sixth sheet and hence the group end 530 is outside the sheet state parameter determination depth 710. The maximum subgroup sheet number is, for example, five sheets. In this case, the subgroup end 220 is not placed on the fifth sheet but on the third sheet, since otherwise the option exists that the next subgroup only enters into the subsequent collecting station when the group end 530, as shown, is in the row behind the sheet state parameter determination depth 710. Alternatively, the subgroup end 220 could be determined again in the next operating cycle. If the group end 530 were still not within the sheet state parameter determination depth 710, for optimizing the cycle performance of the sheet handling plant further, the subgroup end 220 could be placed one row back to sheet five.

In some embodiments according to the invention, a last sheet of a row is determined as subgroup end, when the group end is within the sheet state parameter determination depth, and when the group end is outside the maximum subgroup sheet number. In the main processing direction, the row in which the subgroup end lies is at least two rows before that row where the group end is.

Thus, the subgroup end is determined such that at least the last two rows are processed in a common subsequent subgroup. Thus, it can be ensured that the last subgroup of a group has also two entries into, for example, a collecting station.

Figure 8:
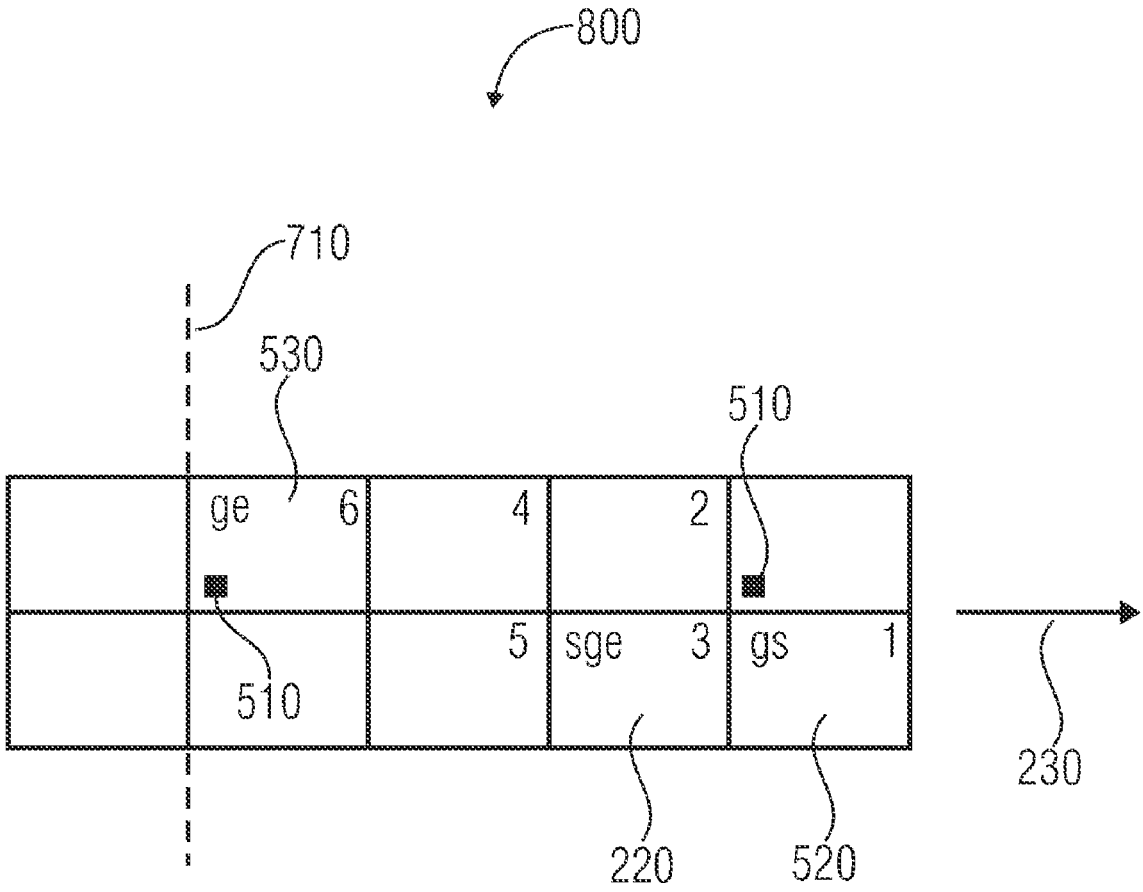
FIG. 8 is a schematic illustration of a sheet stream having a specific subgroup.

Correspondingly, FIG. 8 shows a schematic illustration of a sheet stream 800 with a specific subgroup corresponding to an embodiment of the invention. In this example, the sheet stream 800 comprises a group with six sheets and the parameter determination depth 710 is four rows, corresponding to eight sheets. Thus, the group end 530 is within the sheet state parameter determination depth 710. The maximum subgroup sheet number is, for example, five sheets. Thus, the group cannot be processed as a whole and has to be divided into subgroups. In this example, the subgroup end 220 is set on sheet three, i.e. two rows before the group end 530 for allowing two entries into a subsequent processing station for the last subgroup of the group. If the subgroup end were set on sheet five, the last subgroup would include only one sheet (sheet six) and hence only one entry into the subsequent processing station, which can have a negative effect on the cycle performance of the sheet handling plant.

Several embodiments according to the invention comprise determining a following subgroup end of a following subgroup of sheets based on the sheet state parameter. The following subgroup is determined by a following subgroup start and a following subgroup end. The following subgroup start is determined by the determined subgroup end of the determined subgroup, in this context also called first subgroup.

The following subgroup can directly follow the first subgroup (the determined subgroup). Alternatively, a further subgroup can be between the first subgroup and the following subgroup. The following subgroup start is then indirectly determined by the start and end of the further subgroup by the determined subgroup end of the first subgroup, since start and end of the further subgroup is also determined by the determined subgroup end of the first subgroup.

Thus, after determining a first subgroup of the group of sheets in a sheet stream starting from the group start, a further subgroup, the following subgroup, can also be determined based on the sheet state parameter.

The following subgroup end is, for example, determined such that the following subgroup end corresponds to the group end of the group, when the following subgroup determined thereby does not include more sheets than a maximum subgroup sheet number.

If the subgroup end of the following subgroup or a further subgroup corresponds to the group end, for example, the subgroup end of this group can be made equal to the group end or the subgroup end of this group can be deleted and can be replaced by the group end.

Alternatively or additionally, the following subgroup end can be determined, such that the following subgroup end corresponds to the group end of the group, when the following subgroup determined thereby does not include more sheets than a maximum subgroup sheet number, and when the group end is within the sheet state parameter determination depth. Thus, when determining the following subgroup, it can be determined whether the group end is within the sheet state parameter determination depth, and whether the following subgroup includes more sheets than the maximum subgroup sheet number.

Generally, all regulations or procedures described already above for determining the subgroup can also be applied for determining the following subgroup. In the same way, both regulations or procedures described above for determining the subgroup, and the rules or regulations described for determining the following subgroups can be used for determining further subgroups following the following subgroup or lying between the following subgroups and the determined subgroup or the first subgroup.

Figure 9:
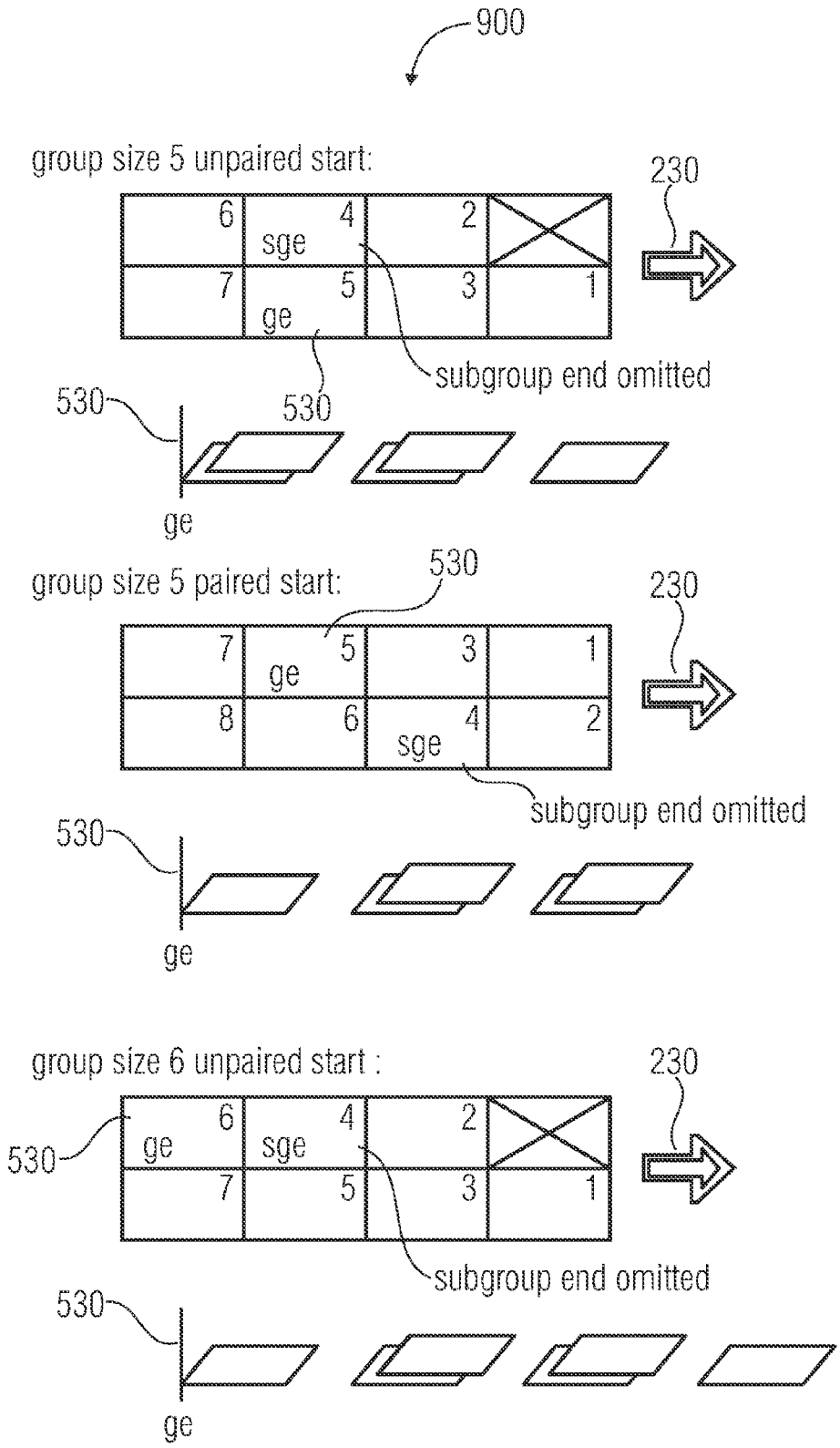
FIG. 9 is a schematic illustration of examples of group formation.
Figure 10:
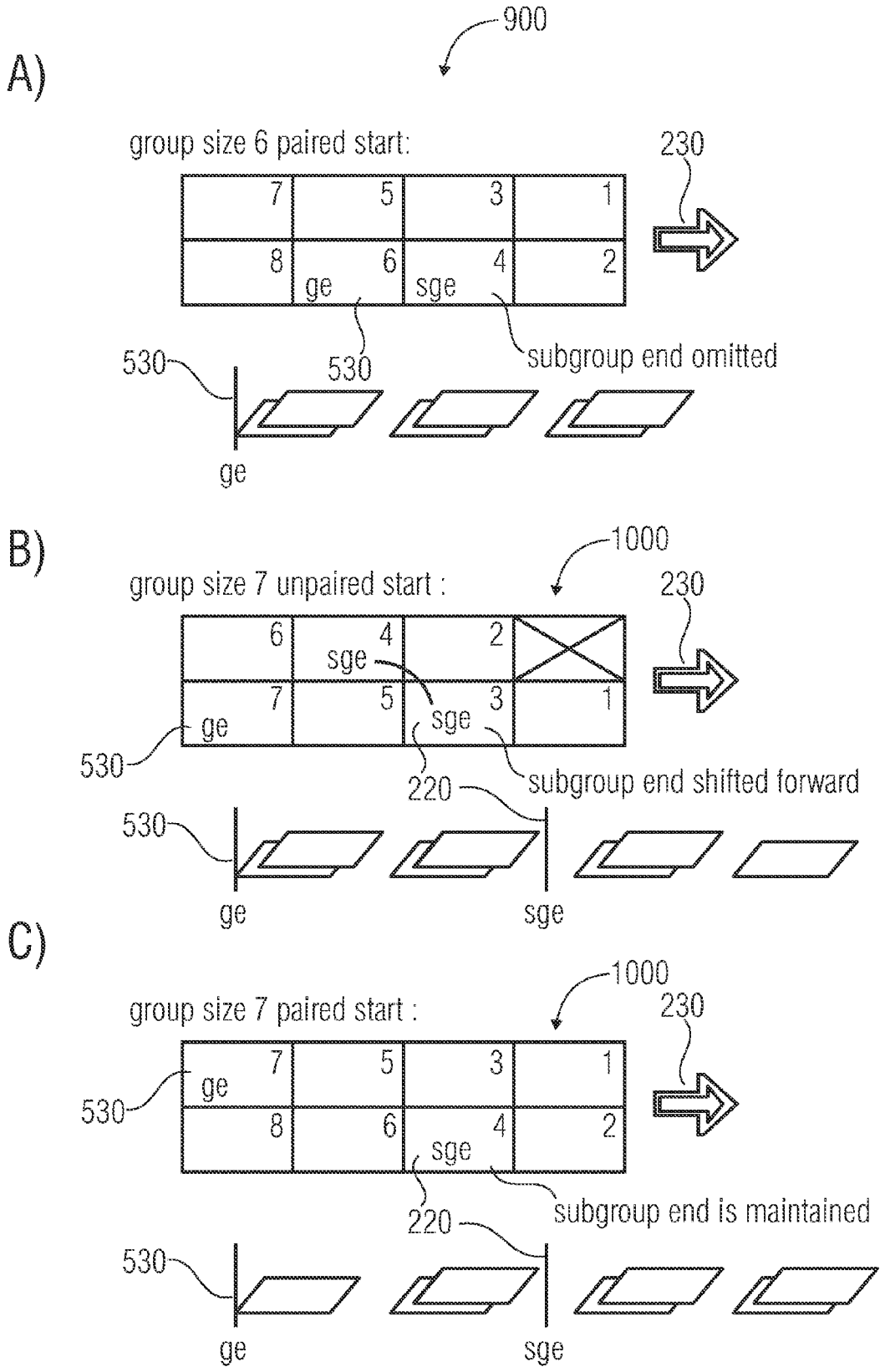
FIG. 10*a* is a schematic illustration of examples of group formation.
FIG. 10*b*, 10*c* is a schematic illustration of a sheet stream having a specific subgroup.

FIGS. 9 and 10*a* show a schematic illustration of examples 900 of a group formation. In these examples, a direct comparison is shown between the conventional method with determined subgroup sizes and the usage of the described concept for groups that are smaller than the maximum subgroup sheet number. In this case, no subgroup is formed, but the group can be processed as a whole. With the conventional method (fixed number of sheets in a subgroup), still, subgroups would be formed and hence the cycle performance of the sheet handling plant would be significantly reduced. In the shown examples, the conventional method would generate subgroups, for example, after every four sheets. With the described method, however, the group is processed as a whole. Thus, determining a subgroup is omitted. The Figure shows, for each of the three examples, the sheet stream prior to singularizing the sheets and after singularizing and superimposing the sheets, which can correspond, for example, to the output cycles of a merger.

In the Figure, the described rules are illustrated with the example of a set subgroup size of four in different constellations.

FIGS. 10*b* and 10*c* show a schematic illustration of a sheet stream 1000 with a specific subgroup corresponding to an embodiment of the invention. The two examples each show a group size of seven sheets, one having an unpaired start and one having a paired start. Compared to the conventional method, with an unpaired start (FIG. 10*b*) the subgroup end 220 is shifted forward by one sheet, to allow at least two entries into the subsequent processing station, e.g. a collecting station. In the example having a paired start, the determined subgroup end 220 would correspond to the subgroup end in the conventional method with a constant subgroup sheet number. Again, for each of the two examples, the sheet stream is shown prior to singularizing the sheets and after singularizing and superimposing the sheets, which correspond, for example, to the output cycles of a merger.

Figure 11:
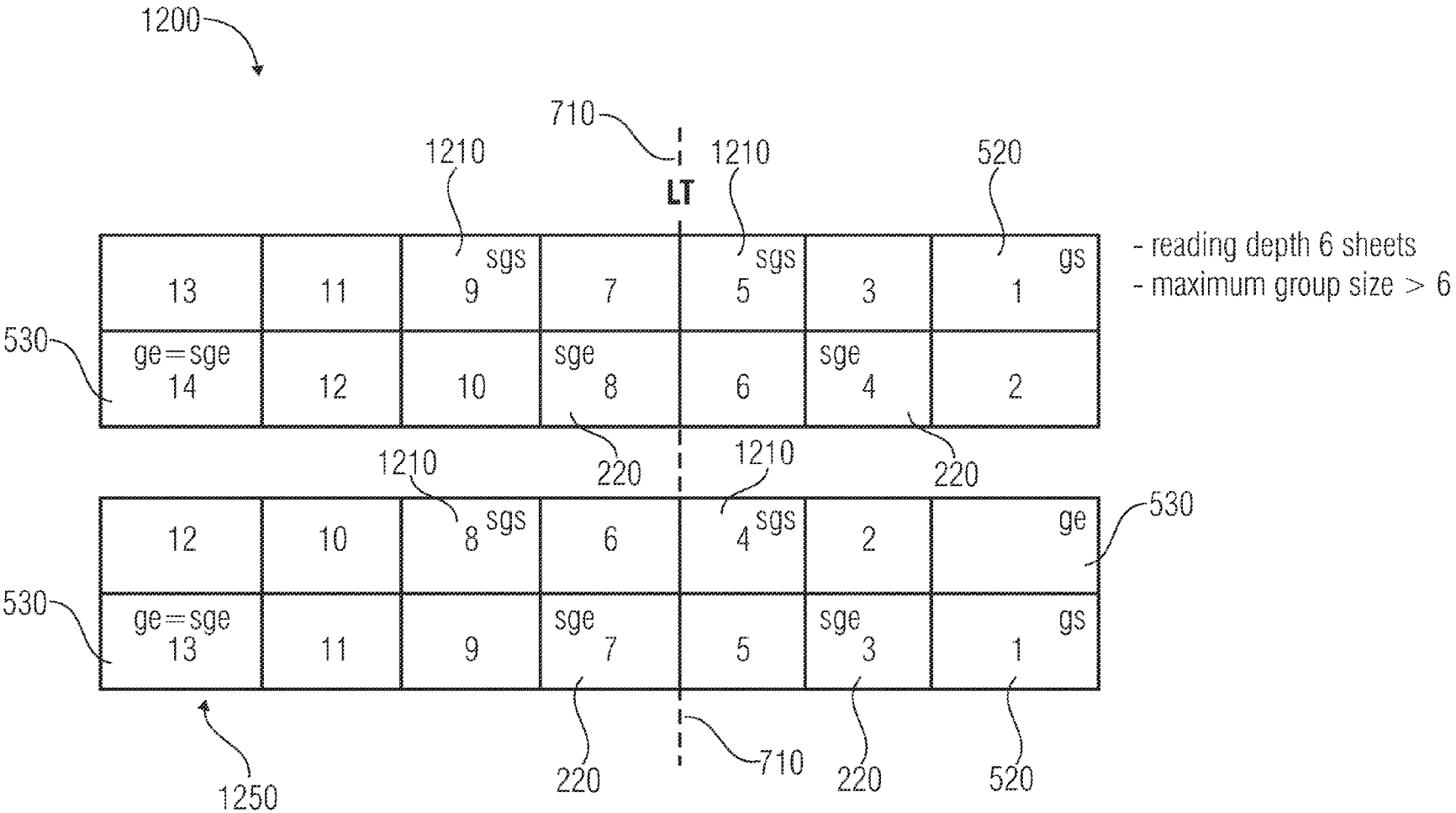
FIG. 11 is a schematic illustration of a sheet stream having a group with paired start and a sheet stream having a group with unpaired start.

FIG. 11 shows a schematic illustration of a sheet stream 1200 with a group having a paired start and a sheet stream 1250 with a group having an unpaired start corresponding to an embodiment of the invention. In this example, the sheet state parameter determination depth 710 or reading depth is six sheets, the maximum subgroup sheet number is more than six sheets and the group having a paired start comprises 14 sheets and the group having an unpaired start comprises 13 sheets. In this example, the group end is outside the sheet state parameter determination depth 710, and the subgroup end 220 of the first subgroup is placed on the fourth sheet. After two operating cycles, the next subgroup is determined. Since the group end is still outside the sheet state parameter determination depth, the subgroup end is again placed on the fourth sheet, which all in all corresponds to the eighth sheet of the group. After two further operating cycles, the last subgroup is determined. Since the group end is within the sheet state parameter determination depth 710 at this time, the subgroup end can be set equal to the end 530 of the group. The subgroup starts are on the first, fifth and ninth sheet. The division of the group 530 in the sheet stream 1250 with unpaired start can be performed according to the division of the group in the sheet stream 1200 with paired start.

The example shown in FIG. 11 corresponds to determining subgroups without renewed determination after every operating cycle. The cycle performance of the sheet handling plant can be improved further when a specific subgroup end is determined again after every cycle. Thereby, the maximum subgroup sheet number can be utilized better.

Figure 12:
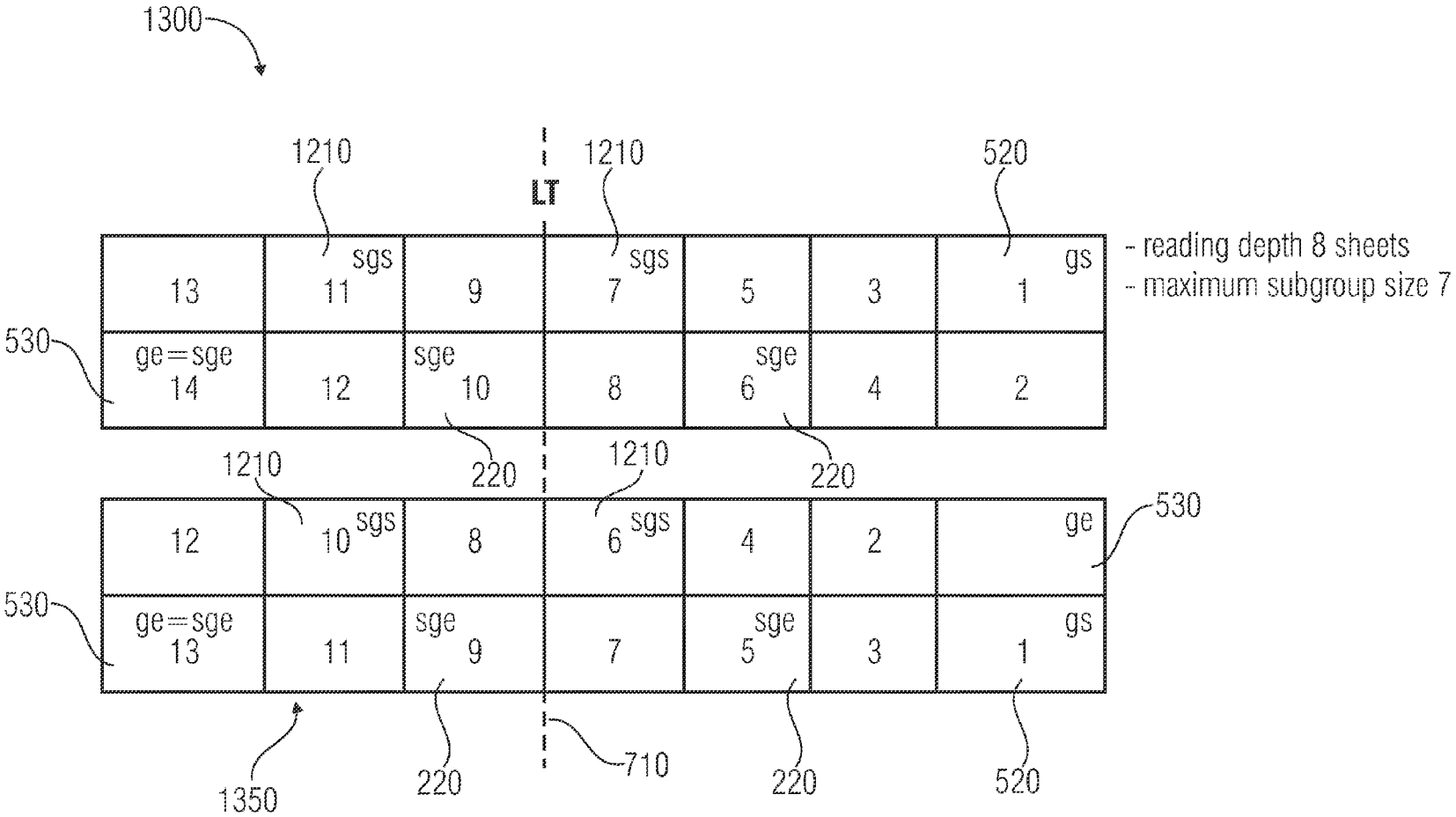
FIG. 12 is a schematic illustration of a sheet stream having a group with paired start and a sheet stream having a group with unpaired start.

FIG. 12 shows a further schematic illustration of a sheet stream 1300 with a group having a paired start and a sheet stream 1350 with a group having an unpaired start corresponding to an embodiment of the invention. In this example, the sheet state parameter determination depth 710 is eight sheets and the maximum subgroup size is seven sheets. The group having a paired start is again 14 sheets and the group having the unpaired start comprises 13 sheets. When determining the first subgroup end 220, the group end 530 is outside the sheet state parameter determination depth 710. However, the subgroup end 220 is not placed on sheet seven, which would correspond to the maximum subgroup size, but on sheet 6 to ensure a paired termination of the subgroup. Then, the next subgroup start 1210 is on sheet 7, wherein at this time the group end is within the sheet state parameter determination depth 710 but outside the maximum subgroup size 7. Thus, the next subgroup end 220 is determined on sheet 10, in order to ensure two entries into the collecting station also for the last subgroup.

With an unpaired start, the first subgroup end 220 will not be placed on sheet seven, which would correspond to the maximum subgroup size, but on sheet five, since the group end 530 is outside the sheet state parameter determination depth 710. If the subgroup end were placed on sheet seven and the group end 530 were on sheet eight or nine, only one entry into the collecting station for the last subgroup would result, which could have a negative effect on the cycle performance of the sheet handling plant. Determination of the first subgroup corresponds to the one having a paired start.

Again, further cycle performance improvement can be obtained when the subgroup ends are determined again after every operating cycle. Determining again relates, for example, to the current subgroup up to the time when the subgroup end can no longer be changed for further processing. Then, the subgroup end of the next subgroup can be determined.

Figure 13:
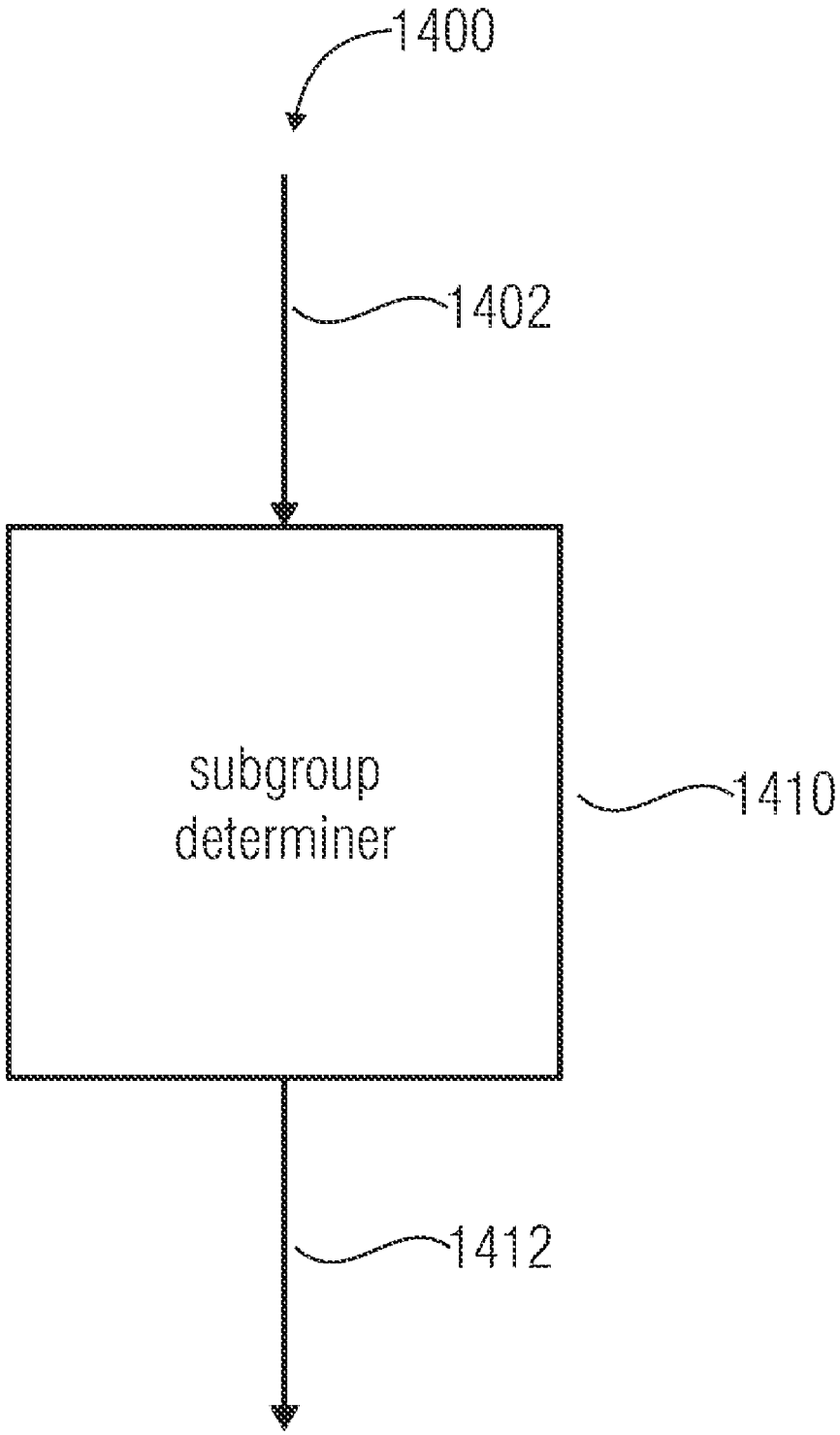
FIG. 13 is a block diagram of an apparatus for determining a subgroup of a group of sheets.

FIG. 13 shows a block diagram of an apparatus 1400 for determining a subgroup of a group of sheets in a sheet stream starting from a group start corresponding to an embodiment of the invention. The subgroup is determined by the group start and a subgroup end 412 and comprises a variable number of sheets. The apparatus comprises a subgroup determiner 1410 determining a subgroup end 1412 based on a sheet state parameter 1402. The sheet state parameter 1402 determines which sheet in the sheet stream is a group end of the group of sheets.

The subgroup determiner 1410 can be implemented to perform method steps, rules or regulations of the described concept. The subgroup determiner 1410 can, for example, be a specifically designed hardware, a processor, computer or software program running on one or several computers or microcontrollers. The apparatus 1400 for determining the subgroup can, for example, be part of a sheet handling plant or a computer program running on a computer of a sheet handling plant.

Some embodiments of the invention relate to an apparatus for determining a subgroup with a detector, which is implemented to detect state information on a sheet of the sheet stream, wherein the sheet state parameter of the sheet is based on the detected state information.

Some further embodiments of the invention relate to a sheet handling plant for processing a sheet stream. Here, the sheet stream comprises a plurality of successive rows of sheets, wherein every row comprises at least two adjacent or superimposed sheets. The sheet handling plant includes an apparatus for determining a subgroup corresponding to the above-described concept and a collecting station. The collecting station collects the sheets of subgroup and outputs the subgroup after collecting all sheets of the subgroup, wherein the subgroup is determined by the apparatus for determining a subgroup.

Further, the sheet handling plant can include a folding unit, a separating device, a compilation web, a supplement feeder, an inserter, an output belt and/or a franking device.

The described concept can be applied both in continuously operating sheet handling plants and in clocked sheet handling plants (e.g. start-stop operation).

The inventive concept can be realized, for example, in sheet handling plants as shown in FIGS. 14 to 17 and already described in the beginning.

Figure 14:
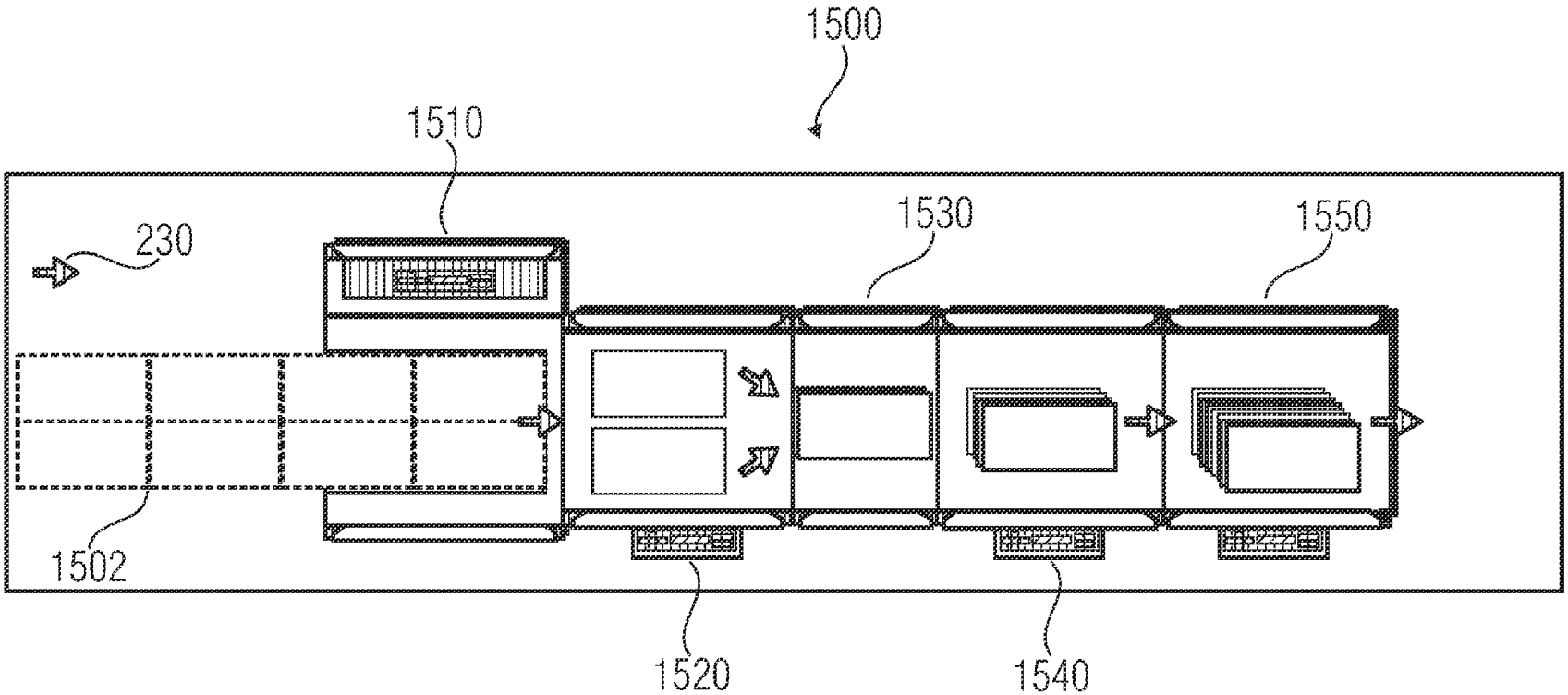
FIGURE 14 PRIOR ART
FIG. 14 is a schematic illustration of a sheet handling plant.
Figure 15:
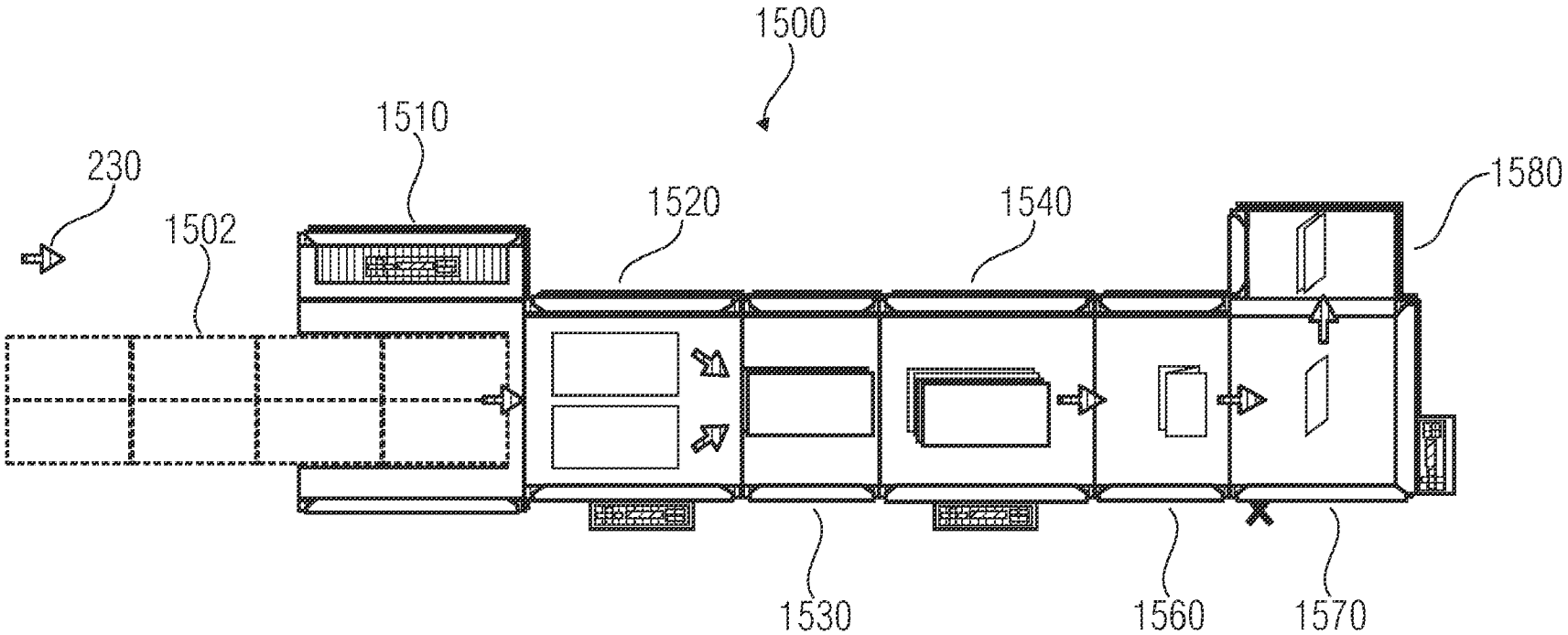
FIGURE 15 PRIOR ART
FIG. 15 is a schematic illustration of a sheet handling plant.

In the sheet handling plant 1500 of FIG. 14, the merger 1520 or the stop location 1530 can be implemented to retain one or several sheets of a row that do not belong to the same subgroup as the first sheet of the row. For example, the subgroup end has to be determined at this location at the latest. The apparatus for determining the subgroup can, for example, be part of the separating device, the merger 1520 or the stop location 1530 or can also run as a computer program on a computer which controls the whole or part of the sheet handling plant.

Figure 16:
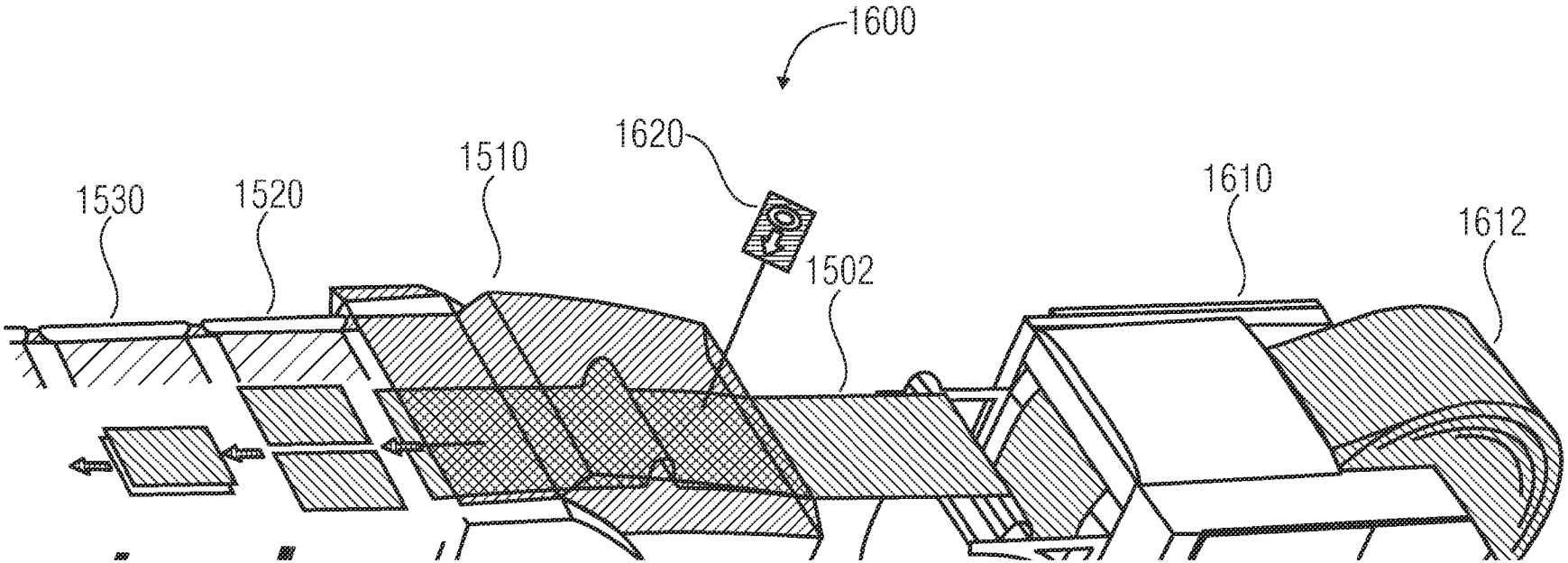
FIGURE 16 PRIOR ART
FIG. 16 is a schematic illustration of part of a sheet handling plant.
Figure 17:
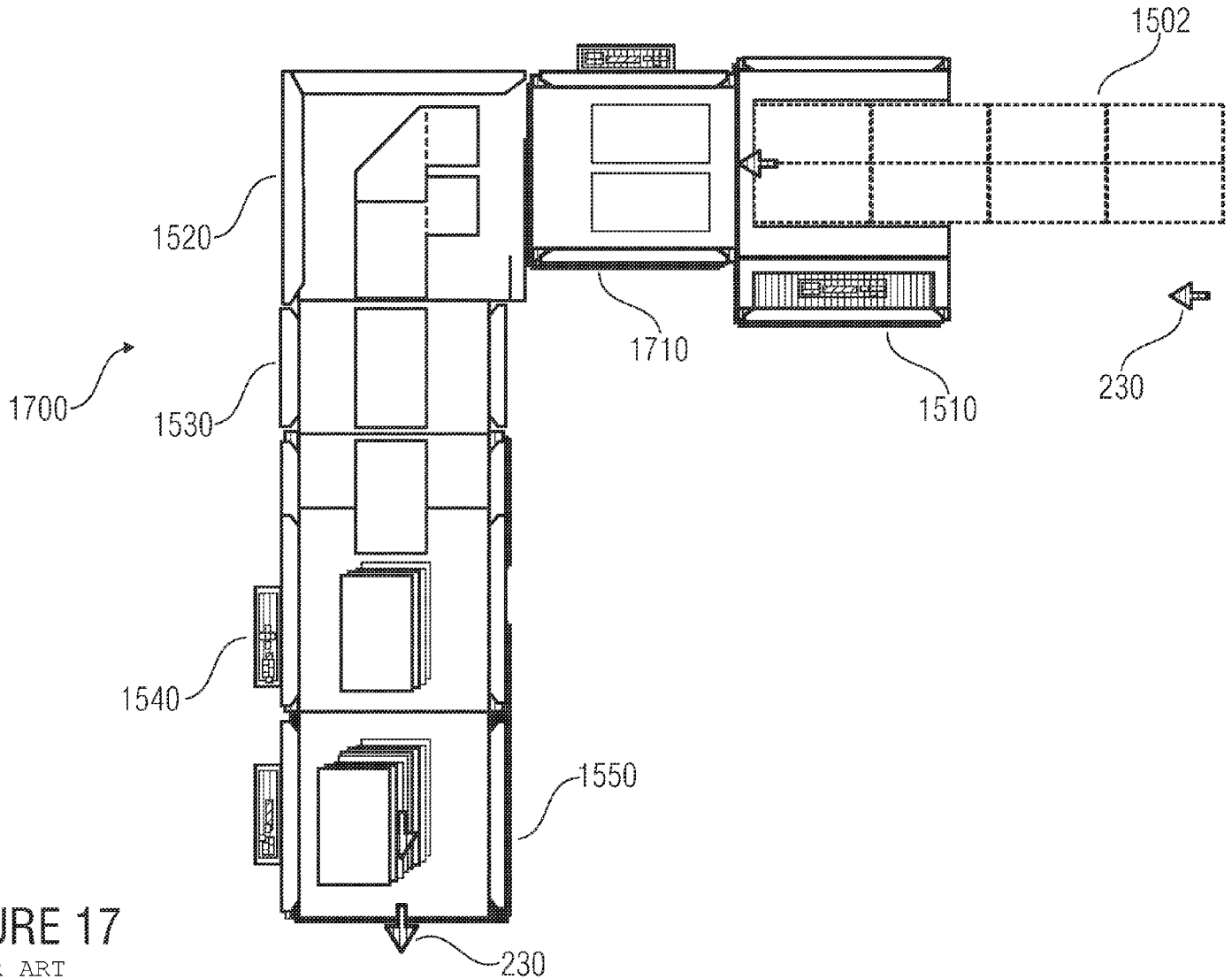
FIGURE 17 PRIOR ART
FIG. 17 is a schematic illustration of a sheet handling plant.

As, for example, shown in FIG. 16, for example, a sensor or detector 1620 can be integrated into the separating device 1510, which can read or detect state information from the sheets of the sheet stream 1502. For example, that part of the sheet stream 1502 which is between the detector 1620 and the merger 1520 or stop location 1530 can be referred to as sheet state parameter determination depth.

Several embodiments according to the invention relate to intelligent formation of a subgroup based on the group size. Thereby, the reading depth or sheet state parameter determination depth is, for example, equal to six sheets and a variation of the size of the subgroup from three to six sheets is possible. Subgroups are, for example, formed only with group sizes of more than six sheets. For example, optimizing the subgroups to entries with two sheets simultaneously is performed, if the sheet stream includes two adjacent sheets per row, for example, with large unpaired groups, a first triple-subgroup can be performed. Optionally or additionally, formation of the subgroup can be optimized, such that at least two entries into the collecting station take place.

In an intelligent formation of the subgroups, not like before, a fixed number of sheets (commonly, for example, four sheets) is transferred to the collecting station as a subgroup. The size of the subgroup varies, for example, when four sheets are set, between outputs of 3 to 6 sheets.

By this flexibility, for example, on the one hand, intermediate outputs can be completely omitted (e.g. five or six sheets collecting amount) or the subgroup end can be shifted such that the collecting station does not have to perform an intermediate output due to a single output of the merger. This can significantly increase the cycle performance since the collecting station might take longer for an output cycle than the merger.

Additionally, by intelligently shifting the subgroup end, it can be obtained that the merger is less frequently in an unpaired state and hence has to output individual sheets. This can additionally increase the performance of the channel (the sheet handling plant).

Several embodiments according to the invention relate to realizing intelligent subgroup formation. Increasing the cycle performance can be obtained by optimized formation of subgroups. Therefore, the following rules can be followed when generating the subgroup end bit. First, after an adjustable sheet counter, a provisional subgroup end can be set. If a group end is on the next or the sheet after that, the subgroup end can be deleted. Thereby, the subgroup can increase by, for example, two sheets as compared to the first setting. The following components have to be able to accommodate this group size. If the first subgroup end is on the first volume (i.e. unpaired subgroup end) and no group end is on the next sheet and the sheet after that, the subgroup end can be shifted forward by one sheet.

These rules can be realized, for example, during reading (when detecting the state information) or in the cutting machine (separating device) since in the entry of the merger, the subgroup end already has to be determined in order to be able to build up a good distance to the following volume at the subgroup end. Within this good distance, the collecting station can output the subgroup to the follower.

By integrating the intelligent formation of subgroups, the cycle performance can be significantly increased for large collecting amounts. In particularly unfavorable constellations, for example, increases by 35% compared to the processing with fixed subgroups are possible.

When the intermediate output is set to, for example, four sheets, the actual subgroup, however, can include up to six sheets (maximum subgroup sheet number). This has to be considered, for example, when configuring the folding unit.

The functionality of the intelligent formation of subgroups can be applied, for example, to code reading (detecting state information). The respective code (state information) should be read in time in order to have a sufficient number of volumes as buffer prior to the output of, for example, the separating device, the merger or the stop location.

Several embodiments according to the invention relate to an application of the method for determining a subgroup for printing stream optimization, for example, by integrating state information on one or several sheets and then printing the same when printing the sheet stream. For this, for example, the data stream can be edited at a PC prior to printing. The necessitated computing effort is substantially lower compared to a method changing the order of the groups in the sheet stream for optimization.

As an alternative for printing on state information, for example, sheet numbers can be stored based on which the sheet state parameter of the sheets can be determined. For example, all sheet numbers of sheets that are a group end or a group start can be stored. The sheet state parameters can then be determined based on the stored sheet numbers. For this, the stored sheet numbers can, for example, be read in a preprocessing step by the sheet handling plant.

Generally, it should be noted that depending on the circumstances, the inventive scheme can also be implemented in software. The implementation can be made on a digital memory medium, in particular a disk or a CD having electronically readable control signals that can cooperate with the programmable computer system such that the respective method is performed. Generally, the invention consists also of a computer program product having a program code stored on a machine readable carrier for performing the inventive method when the computer program product runs on a computer. Thus, the invention can be realized as a computer program having a program code for performing the method when the computer program product runs on a computer.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. Method for determining a subgroup of a group of sheets in a sheet stream starting from a group start of the group, wherein the subgroup is determined by the group start and a subgroup end, and wherein the subgroup comprises a variable number of sheets, wherein the sheet stream comprises a plurality of successive rows of sheets, wherein one row is arranged perpendicular to a main processing direction of the sheet stream, and wherein each row comprises at least two adjacent or superimposed sheets, comprising:

determining the subgroup end of the subgroup based on a sheet state parameter, wherein the sheet state parameter determines which sheet in the sheet stream is a group end of the group of sheets.

2. Method according to claim 1, wherein the sheets of the sheet stream are, at the time of determining the subgroup end, connected to each other, singularized or only separated from each other longitudinal to the main processing direction, and are arranged, for further processing, adjacent, superimposed or laterally offset to one another.

3. Method according to claim 1, wherein a previous group end or the sheet state parameter determines the group start of the group.

4. Method according to claim 1, comprising:

determining the sheet state parameter of a sheet based on state information on at least one of the sheets or from a data base.

5. Method according to claim 4, wherein the sheet state parameter of a sheet is determined based on the state information, wherein state information is on a last sheet of each group of sheets in a sheet stream or wherein state information is on a first sheet of each group of sheets in a sheet stream.

6. Method according to claim 1, wherein a number of sheets of the determined subgroup and a number of sheets of a previous determined subgroup differ.

7. Method according to claim 1, wherein determining the subgroup end is based on a sheet state parameter determination depth of the sheet state parameter, wherein the sheet state parameter determination depth states a number of successive sheets in the sheet stream, wherein for the number of successive sheets, the associated sheet state parameters are known at a time of determining the subgroup end, wherein determining the subgroup end is based on at least part of the associated sheet state parameters.

8. Method according to claim 1, wherein the subgroup end is determined, such that all adjacent or superimposed sheets of a row belong to the subgroup when the group end is not within a maximum subgroup sheet number in the sheet stream, wherein, when determining the subgroup, it is determined whether the group end is within the maximum subgroup sheet number.

9. Method according to claim 7, wherein the sheet state parameter determination depth in the sheet stream ranges from a start sheet of the determination depth start row up to an end sheet of a successive determination depth end row, and hence states a number of successive sheets corresponding to one or a plurality of a number of sheets in one row.

10. Method according to claim 9, wherein a last sheet of a row is determined as subgroup end when the group end is not within the sheet state parameter determination depth, wherein the row in which the subgroup end is is directly before the determination depth end row in the main processing direction, wherein, when determining the subgroup, it is determined whether the group end is within the sheet state parameter determination depth.

11. Method according to claim 9, wherein a last sheet of a row is determined as subgroup end when the group end is within the sheet state parameter determination depth, and when the group end is outside the maximum subgroup sheet number, wherein the row in which the subgroup end is at least two rows before that row in which the group end is in the main processing direction.

12. Method according to claim 1, wherein the subgroup end is determined during an operating cycle, and wherein the subgroup end is determined again in a successive operating cycle, wherein the newly determined subgroup end corresponds to the previously determined subgroup end or wherein the newly determined subgroup end is further downstream in the sheet stream than the previously determined subgroup end in a main processing direction.

13. Method according to claim 1, wherein sheets in the sheet stream are already separated from each other or still connected to each other.

14. Method according to claim 1, comprising:

determining a following subgroup end of a following subgroup of sheets based on a sheet state parameter, wherein the following subgroup is determined by a following subgroup start and a following subgroup end, wherein the following subgroup start is determined by the determined subgroup end of the determined subgroup.

15. Method according to claim 14, wherein the following subgroup end is determined such that the following subgroup end corresponds to the group end of the group, when the following subgroup determined thereby does not comprise more sheets than a maximum subgroup sheet number.

16. Method according to claim 14, wherein the following subgroup end is determined such that the following subgroup end corresponds to the group end of the group, when the following subgroup determined thereby does not comprise more sheets than a maximum subgroup sheet number, and when the group end is within the sheet state parameter determination depth, wherein when determining the following subgroup, it is determined whether the group end is within the sheet state parameter determination depth, and whether the following subgroup comprises more sheets than the maximum subgroup sheet number.

17. A non-transitory computer readable medium including a computer program comprising a program code for performing, when the computer program runs on a computer or microcontroller, a method for determining a subgroup of a group of sheets in a sheet stream starting from a group start of the group, wherein the subgroup is determined by the group start and a subgroup end, and wherein the subgroup comprises a variable number of sheets, wherein the sheet stream comprises a plurality of successive rows of sheets, wherein a row is arranged perpendicular to a main processing direction of a sheet stream, and wherein every row comprises at least two adjacent or superimposed sheets, comprising:

determining the subgroup end of the subgroup based on a sheet state parameter, wherein the sheet state parameter determines which sheet in the sheet stream is a group end of the group of sheets.

* * * * *